United States Patent [19]

Nordin

[11] 4,416,320

[45] Nov. 22, 1983

[54] LADDER TAPE ROLL FOR VENETIAN BLINDS

[75] Inventor: Inge Nordin, Hökerum, Sweden

[73] Assignee: Roland Olofsson, Lerum, Sweden

[21] Appl. No.: 398,387

[22] Filed: Jul. 14, 1982

[51] Int. Cl.[3] ..... E06B 9/38

[52] U.S. Cl. ..... 160/177

[58] Field of Search ..... 160/176, 177, 178 R, 160/178 F

[56] References Cited

U.S. PATENT DOCUMENTS

| | | | |
|---|---|---|---|
| 2,534,080 | 12/1950 | Stuber et al. | 160/176 |
| 2,837,152 | 6/1958 | Moore, Jr. | 160/176 |
| 2,918,968 | 12/1959 | Schultz | 160/177 |

FOREIGN PATENT DOCUMENTS

| | | | |
|---|---|---|---|
| 222908 | 10/1968 | Sweden | 160/178 |

*Primary Examiner*—Peter M. Caun

*Attorney, Agent, or Firm*—Holman & Stern

[57] ABSTRACT

A ladder tape roll (1) for venetian blinds and having a through hole (2) for receiving and for unrotatable connection with the tilting bar of the blind and provided with means (6) for axial locking of the ladder tape roll in relation to the tilting bar and provided with fixing means (10) for the ladder tapes (b 9) of the blind. One end of the roll (1) is slotted (3) and conically tapered (4), and has a part provided with outer threads (5). A nut (6) having inner threads (7) and an inner conical part (8) having smaller dimension than the conical part (4) of the roll are provided to press the slotted (3) part of the roll together for squeezing and axially locking the ladder tape roll to the tilting bar by tightening around said threads (5) of the roll.

2 Claims, 3 Drawing Figures

LADDER TAPE ROLL FOR VENETIAN BLINDS

The present invention relates to a ladder tape roll for venetian blinds and having a through hole for receiving and for an unrotatable connection with the tilting bar of the blind and provided with means for axial locking of the ladder tape roll in relation to the tilting rod and fixing means for the ladder tapes of the blind.

In ladder tape rolls, which are used at present the axial locking in relation to the tilting bar is achieved by way of a stop screw which is screwed into contact with said bar. At production of the ladder tape roll, which is moulded in plastics, it is necessary to drill a threaded hole for the stop screw in the roll after the moulding. This is of course complicated. The fixing means for the ladder tapes usually consists of a steel tongue, which is fixed by moulding to the roll and projects a small distance therefrom. The ladder tapes are brought under the tongue, which by way of a punch is pressed into contact with the roll, the ladder tapes thereby being fixed under the tongue. This is complicated from a manufacturing point of view and it is furthermore impossible to loosen the ladder tapes from the ladder tape roll afterwards. When replacing ladder tapes the roll therefore must also be replaced.

PURPOSE AND MOST ESSENTIAL FEATURES OF THE INVENTION

The purpose of the present invention is to provide a ladder tape roll which is more simple and which can be manufactured to smaller costs and which can be formed in one piece of plastics without subsequent finishing. The invention is primarily directed to the axial locking of the ladder tape roll to the tilting bar, which has been achieved thereby that one end of the roll is slotted and conically tapered, and has a part provided with outer threads, and that a nut having inner threads and an inner conical part of smaller dimensions than the conical part of the roll is arranged by tightening on said threads to press the slotted part of the roll together for squeezing and locking the ladder tape roll axially to the tilting bar.

DESCRIPTION OF THE DRAWINGS

The invention will be further described below, reference being made to an embodiment shown on the accompanying drawing.

DESCRIPTION OF THE PREFERRED EMBODIMENTS

Figure 1:
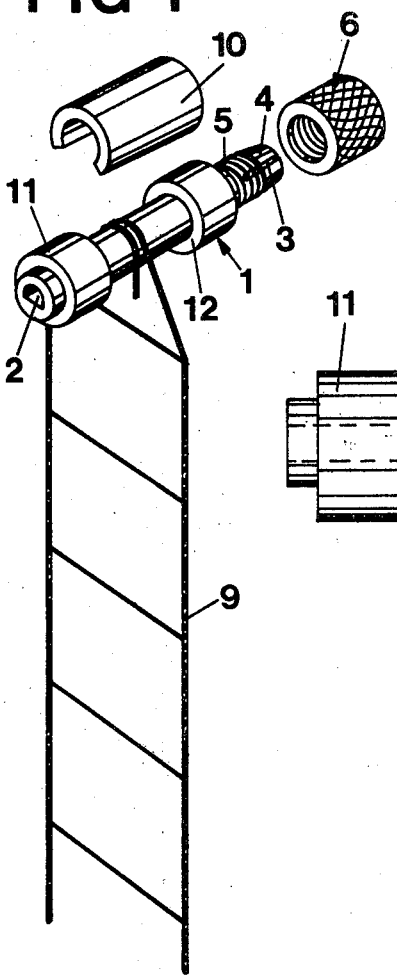
FIG. 1 is an exploded view in perspective of a ladder tape roll according to the invention with ladder tapes attached thereto.
Figure 2:
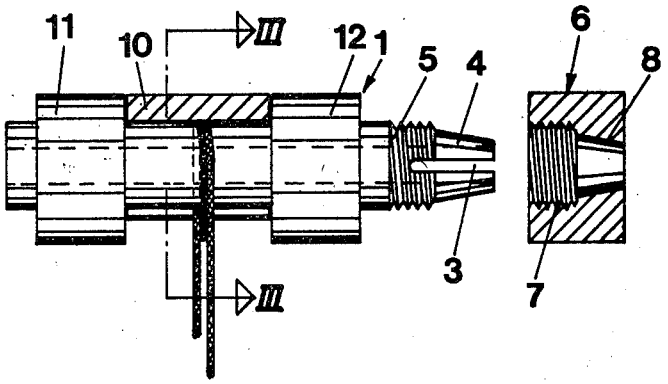
FIG. 2 is a side view of the ladder tape roll.
Figure 3:
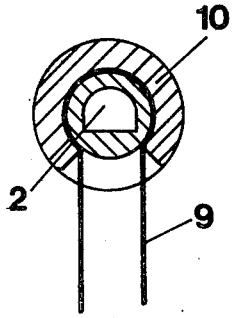
FIG. 3 is a sectional view on line III—III in FIG. 2.

The ladder tape roll designated 1 on the drawing is intended to be supported in a bracket (not shown), which is provided in a U-shaped support bar for a venetian blind.

The ladder tape roll 1 has a through hole 2 having a non-circular, usually semi-circular section for receiving a tilting bar of conventional type (not shown). The tilting bar has a non-circular section corresponding to that of the hole 2 and is thus unrotatably connected to the ladder tape roll 1.

At one end the ladder tape roll 1 is provided with a slotted 3 conical part 4 and adjacent the conical part a part provided with outer threads 5. For axial locking of the ladder tape roll 1 in relation to the tilting bar a nut 6 is provided, which has a part with inner threads 7 corresponding to the outer threads 5 of the ladder tape roll. Adjacent the threaded part 7 the nut 6 has an inner conical part 8, the dimensions of which are somewhat smaller than the conical part 4 of the ladder tape roll 1. When tightening the nut 6 on the threads 5 of the roll the slotted 3 conical part 4 will be pressed together and squeeze the roll 1 around the tilting bar, that is it will lock the ladder tape roll axially in relation to the tilting bar.

For fixing the ladder tapes 9 of the blind to the roll 1 a slotted sleeve 10 is provided, which is resiliently snapped around the roll and thus locks the ladder tapes 9 applied around the roll. The sleeve 10 is locked in axial direction between a couple of circumferential collars 11 and 12 of the ladder tape roll 1.

The ladder tape roll 1 according to the invention as well as the nut 6 and the slotted sleeve 10 can be formed in one piece of plastics without any subsequent finishing or machining. The fixing of the ladder tapes 9 to the ladder tape roll 1 can occur without the need of special tools and if the ladder tapes 9 are to be replaced the sleeve 10 can be removed from the roll and can be in position firmly again when new ladder tapes have been applied.

The invention is of course not restricted to the embodiments shown but can be modified within the scope of the following claims.

What I claim is:

1. A ladder tape roll for venetian blinds and having a through hole intended for receiving and for non-rotatable connection with the tilting bar of the blind and provided with means for axial locking of the ladder tape roll in relation to the tilting bar and further being provided with fixing means for the ladder tapes of the blind, wherein one end of the ladder tape roll is conically tapered, said tapered end being provided with a slot and having a portion with outer threads, a nut having inner threads and an inner conical portion of smaller dimensions than the conical portion of the roll being arranged by tightening on said threads to press the slotted portion of the roll together for squeezing and locking the ladder tape roll axially to the tilting bar.

2. A ladder tape roll as claimed in claim 1, wherein said fixing means for the ladder tapes of the blind comprises a slotted sleeve provided to be resiliently snapped around the ladder tape roll thereby locking the ladder tapes applied around the roll.

* * * * *